United States Patent [19]

Corinaldi et al.

[11] 4,209,117

[45] Jun. 24, 1980

[54] BELT BUCKLE

[75] Inventors: Giorgio Corinaldi, Milan, Italy; Jack Shirinian, Orange County, Calif.

[73] Assignee: Lejon of California, Inc., Anaheim, Calif.

[21] Appl. No.: 963,200

[22] Filed: Nov. 24, 1978

[51] Int. Cl.[2] ..... A45C 1/04; A44B 11/22

[52] U.S. Cl. ..... 224/224; 24/163 K; 206/37

[58] Field of Search ..... 24/3 F, 163 KO, 163 L; 224/26 E, 224; 206/37

[56] References Cited

U.S. PATENT DOCUMENTS

| | | | |
|---|---|---|---|
| 603,949 | 5/1898 | Harding | 206/37 R |
| 941,702 | 11/1909 | Fishel | 24/163 KO |
| 981,186 | 1/1911 | Fraser | 206/37 |
| 1,113,834 | 10/1914 | Rumage | 224/163 |
| 1,606,849 | 11/1926 | Spear | 24/163 R X |
| 1,642,629 | 9/1927 | Rankin | 224/26 E |
| 1,753,765 | 4/1930 | Withers | 224/163 |
| 2,042,699 | 6/1936 | Bozin | 206/37 R |

FOREIGN PATENT DOCUMENTS

| | | | |
|---|---|---|---|
| 13829 | of 1928 | Australia | 206/37 |

*Primary Examiner*—William E. Lyddane
*Attorney, Agent, or Firm*—Harris, Kern, Wallen & Tinsley

[57] ABSTRACT

A belt buckle for attachment to one end of a belt and connection to the other end of the belt and having an open interior with a tray mounted for pivoting into and out of the interior, with a detent mechanism for retaining the tray within the buckle and a projecting portion for pivoting the tray out of the buckle.

7 Claims, 5 Drawing Figures

BELT BUCKLE

BACKGROUND OF THE INVENTION

This invention relates to a buckle for a belt or the like and in particular, to a new and improved buckle having a pivoting tray which may serve as a storage space for small items.

Buckles with receptacles which slide in and out of an end of the buckle are known and are shown in U.S. Pat. Nos. 1,113,834; 1,606,849; and 1,753,765. In these earlier devices, the sliding tray is separate from the buckle and may be lost or misplaced. Also, the tray slides in and out of an end of the buckle which places strict limitations on the design and construction of the buckle and particularly the appearance of the buckle.

It is an object of the present invention to provide a new and improved belt buckle having a tray which is pivotally mounted in the buckle. A further object is to provide such a buckle wherein the tray may be pivoted through a slot in a bottom side or a top side rather than sliding through an end side.

Other objects, advantages, features and results will more fully appear in the course of the following description.

SUMMARY OF THE INVENTION

The buckle comprises a housing having an open interior and a slot in one of the sides and means for connecting the housing at each end of a belt, and a tray pivotally mounted in the housing for pivoting out of the housing through the slot. In the preferred embodiment, the tray pivots through a slot in a top or bottom side of the housing and the tray and housing include interengaging detent means for retaining a tray in the housing. This detent preferably is a screw mounted in the housing which engages a notch in a wall of the tray when the tray is pivoted into the housing.

DESCRIPTION OF THE PREFERRED EMBODIMENT

Figure 1:
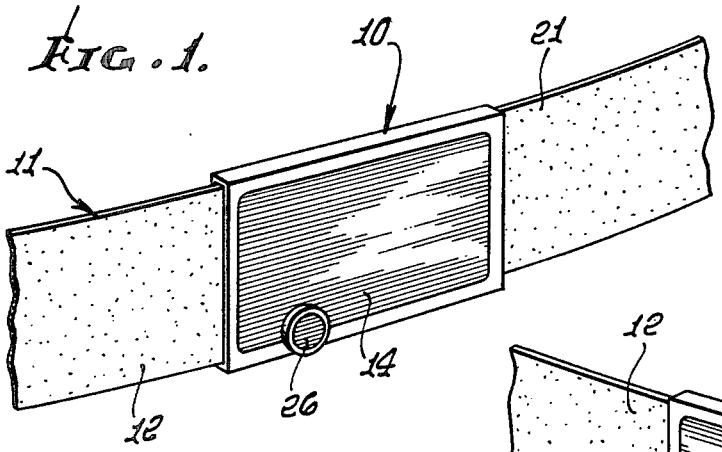
FIG. 1 is a perspective view illustrating a belt buckle and belt incorporating the presently preferred embodiment of the invention.

The drawing illustrates a buckle 10 to which is attached a belt 11. The belt may be attached by various conventional arrangements and in the embodiment illustrated, an end 12 of the belt 11 is positioned in a cavity 13 of a housing 14 of the buckle 10, and is held in place by screws 18 threadedly engaging the housing and passing through openings in the belt.

A bridge member 19 and a boss 20 are carried on the rear face of the housing 14, with the other end 21 of the belt passing under the bridge member 19, and with the boss 20 projecting through an opening 22 in the belt.

A tray 25 is pivotally mounted on a pivot pin 26 which is threadedly mounted in the housing 14. This permits the tray to pivot between the position shown in FIG. 2 and the position shown in FIG. 3, through a slot 27 in the bottom side of the housing 14. When the tray 25 is in the closed position as shown in FIG. 3, substantially filling the open interior of the housing 14, the side wall 28 of the tray substantially fills the slot 19 of the housing.

A detent mechanism is provided for retaining the tray in the closed position within the buckle and preferably comprises a screw 30 threadedly mounted in an end of the housing 14, and a notch or concave portion 31 in a wall of the tray.

Figure 3:
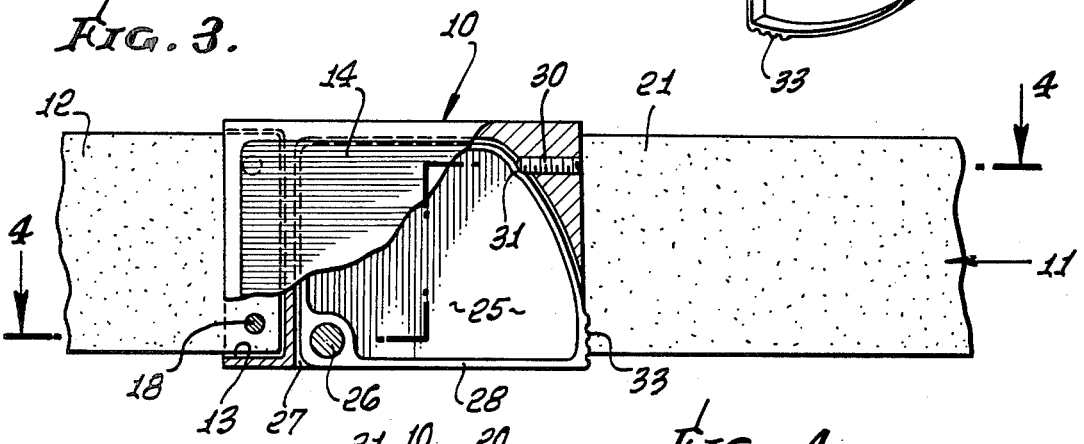
FIG. 3 is a front view of the buckle of FIG. 1 with a portion of the housing broken away to show the internal construction.
Figure 4:
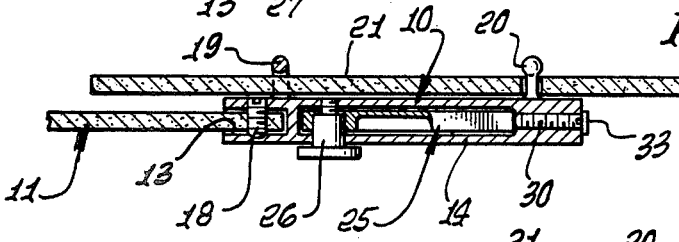
FIG. 4 is a sectional view taken along the lines 4—4 of FIG. 3.
Figure 5:
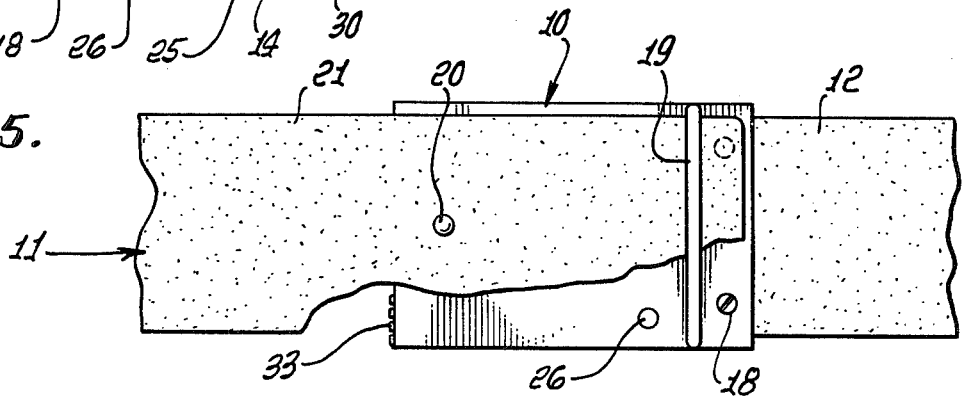
FIG. 5 is a rear view of the buckle of FIG. 1.

The tray may have a projecting portion 33 in the tray wall adjacent the wall 28, with the portion 33 projecting through a slot 34 in the housing when the tray is in the closed position as shown in FIG. 3.

Figure 2:
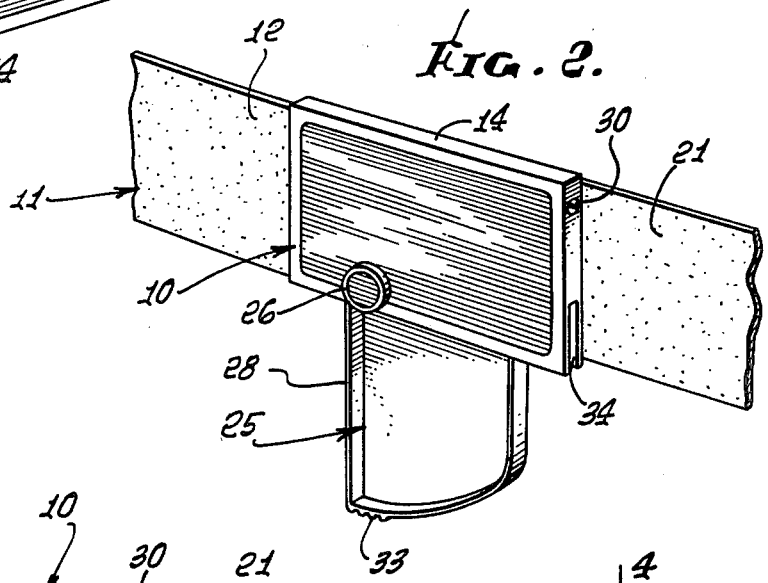
FIG. 2 is a view similar to that of FIG. 1 showing the tray in the extended position.

In use, the tray may be opened by manually grasping the buckle with the thumb at the projecting portion 33 and forcing the tray downward to the position of FIG. 2. The tray may be closed by pivoting it to a substantially closed position and then manually squeezing the tray into the housing bringing the screw 30 into engagement with the notch 31. The amount of detent force may be varied by adjusting the position of the screw 30.

This construction provides a buckle with a receptacle which can be opened and closed at will, and a receptacle which is an integral part of the buckle so that the receptacle is not lost. Further, in the preferred embodiment, the receptacle pivots out of the top or bottom side of the buckle so that the ends can be shaped as desired to provide various changes in appearance and concealment.

We claim:

1. A belt buckle comprising:

a housing having front and rear faces and right, left, top and bottom sides;

first and second means carried at said housing for first and second connections, respectively, to a belt;

said housing having an open interior and a slot in one of said sides; and a tray pivotally mounted inside said housing for pivoting out of said housing through said slot about an axis perpendicular to said rear face.

2. A belt buckle as defined in claim 1 including interengaging detent means in said housing and tray for retaining said tray in said housing.

3. A belt buckle as defined in claim 2 wherein said detent means includes a screw in said housing having an inner end engageable with a notched portion of the wall of said tray.

4. A belt buckle as defined in claim 2 wherein said tray has a first wall substantially filling said slot when said tray is pivoted into said housing, and said tray has a projecting portion extending through a second slot in a second side of said housing adjacent said one side when said tray is pivoted into said housing.

5. A belt buckle as defined in claim 4 wherein said first means includes a cavity in a side of said housing for receiving a belt end, and means for fixing said belt end in said cavity.

6. A belt buckle as defined in claim 5 wherein said second means includes a boss and a bridge member projecting from said rear face for engaging and retaining a belt.

7. A belt buckle comprising:

a housing having front and rear faces and right, left, top and bottom sides;

first and second means carried at said housing for first and second connections, respectively, to a belt;

said housing having an open interior and a first slot in one of said top and bottom sides and a second slot in one of said right and left sides;

a tray pivotally mounted inside said housing for pivoting out of said housing through said first slot about an axis perpendicular to said rear face, said tray having a first wall substantially filling said first slot when said tray is pivoted into said housing and a second wall with a notched portion and a projecting portion, with said projecting portion extending through said second slot; and a screw in said housing having an inner end engageable with said notched portion of said tray's second wall for retaining said tray in said housing.

* * * * *